United States Patent [19]

Stecklow

[11] 4,331,217

[45] May 25, 1982

[54] LADDER STEP AND STABILIZER

[75] Inventor: James P. Stecklow, Broadview Heights, Ohio

[73] Assignee: R.L.S. Enterprises, Inc., Broadview Heights, Ohio

[21] Appl. No.: 142,178

[22] Filed: Apr. 16, 1980

[51] Int. Cl.[3] ..... E06C 7/14; E06C 7/48

[52] U.S. Cl. ..... 182/214; 182/107; 182/121; 248/238

[58] Field of Search ..... 182/214, 206, 116, 120, 182/121, 107, 108; 248/238

[56] References Cited

U.S. PATENT DOCUMENTS

| | | | |
|---|---|---|---|
| 271,509 | 1/1883 | Nolton | 248/238 |
| 812,620 | 2/1906 | Alstine | 248/238 |
| 1,462,086 | 7/1923 | Echlin | 182/121 |
| 1,710,026 | 4/1929 | McCormick | 182/121 |
| 2,680,554 | 6/1954 | Dakin | 182/214 |
| 2,871,067 | 1/1959 | Brogdon | 182/121 |
| 2,881,028 | 4/1959 | Baird | 182/116 |
| 3,419,109 | 12/1968 | Costlow | 182/214 |
| 3,459,277 | 8/1969 | Frederick | 182/214 |
| 3,568,801 | 3/1971 | Werner | 182/214 |

*Primary Examiner*—Reinaldo P. Machado
*Attorney, Agent, or Firm*—Harvey B. Jacobson

[57] ABSTRACT

An attachment for a rung-type ladder which provides a generally horizontally disposed supporting surface such as a step. The attachment includes a pair of downwardly opening generally inverted U-shaped members which are positioned over a pair of adjacent ladder rungs combined with a pair of angulated support members attached thereto and provided with a laterally extending upper end portion which combines with the top surface of the uppermost ladder rung engaging member to attach and support a horizontal generally planar supporting member which extends laterally to both sides of the ladder stiles thereby providing a step to receive the shoes of a person using the ladder to provide comfort and stability thereto or support a paint tray, container, tools and the like. In a second embodiment, the basic structure is connected to the ladder in the same manner but includes telescopically adjustable extension tubes which form part of a stabilizer which includes an elongated cushioned member engaging the wall surface of a building to stabilize and support the ladder in spaced relation to the building wall. In a third embodiment, an optional inner platform is attached to the extension tubes to provide various supporting functions without adjustment. In a fourth embodiment, the wall engaging member of the stabilizer is omitted with outwardly curved end portions of the extension tubes engaging the wall.

18 Claims, 10 Drawing Figures

Fig. 5
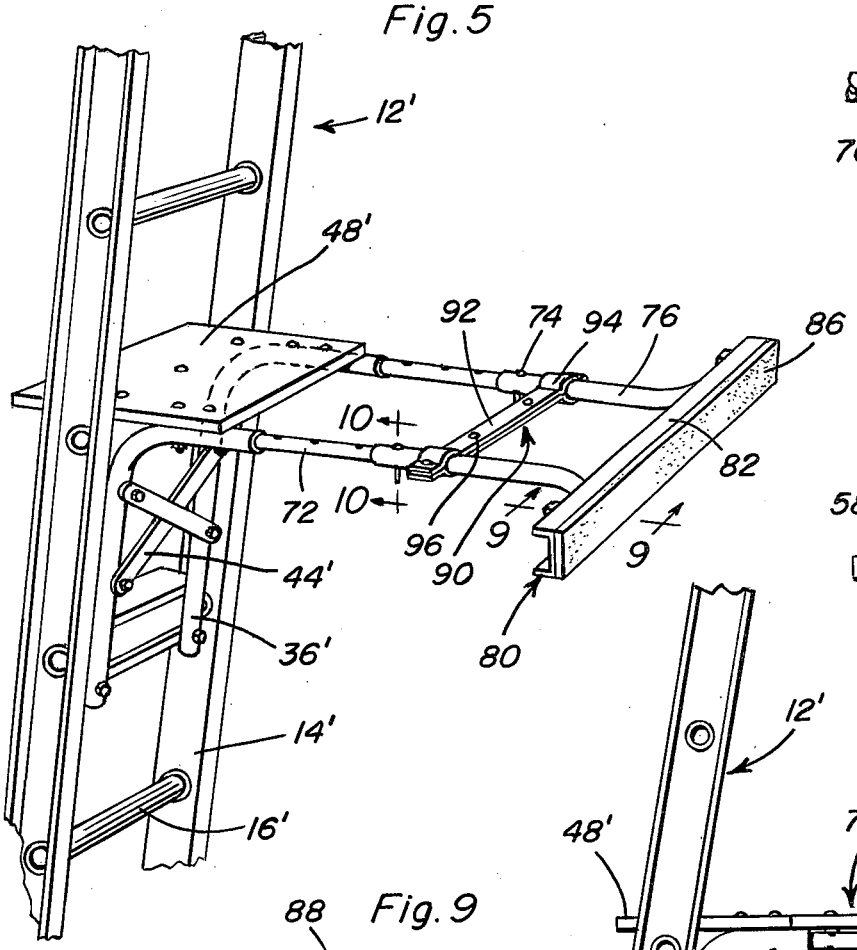
Fig. 8
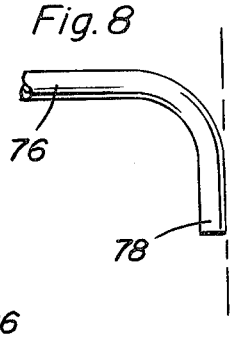
Fig. 6
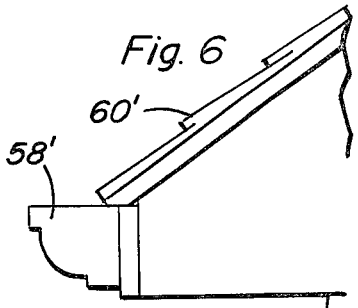
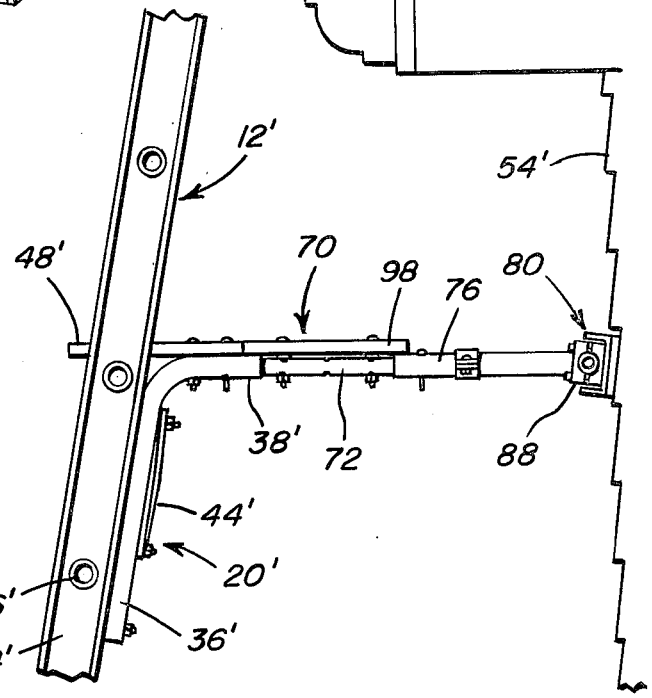
Fig. 9
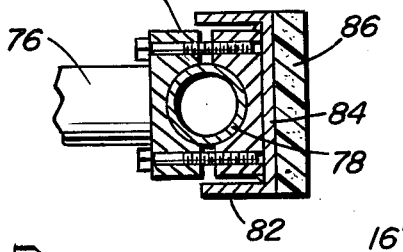
Fig. 7
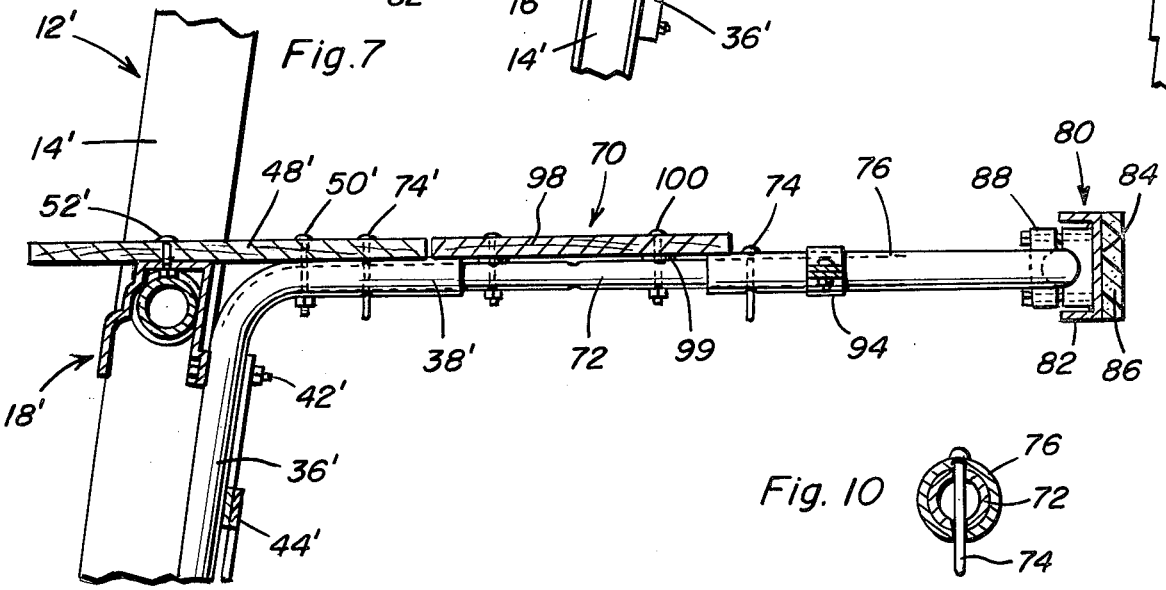
Fig. 10

LADDER STEP AND STABILIZER

BACKGROUND OF THE INVENTION

1. Field of the Invention

The present invention generally relates to an attachment for a ladder which in one embodiment provides a generally horizontal supporting surface extending laterally from both sides of a ladder rung to enable a supporting surface to be fixedly secured to but detachable from the ladder whereby a person using the ladder will be provided with a secure platform that is substantially more comfortable and safe than standing on a ladder rung. In a second embodiment, the attachment additionally includes an adjustable stabilizer having a cushioned member engaging a building wall. In a third embodiment, an extension platform is attached to the stabilizer to provide an additional supporting surface and eliminate adjustment of the stabilizer. In a fourth embodiment, the wall engaging member is removed from the extension tubes which form part of the stabilizer.

2. Description of Relevant Art

Various attachments have been provided for ladders by which paint buckets, containers and the like, paintbrushes and other tools have been effectively supported from the ladder rungs or stiles. Further, devices have been provided to space the upper end of a ladder from the vertical building wall or the like to facilitate access to the building wall, gutters, and the like. The following U.S. patents are exemplary of the art in this field of endeavor: Nos.

812,620
1,462,086
1,710,026
2,439,185
2,871,067

SUMMARY OF THE INVENTION

An object of the present invention is to provide a ladder attachment adapted to be attached to a conventional ladder having parallel stiles and a plurality of horizontally disposed rungs extending therebetween with the attachment including a pair of ladder rung receiving structures to engage at least two ladder rungs and support members attached thereto providing laterally spaced support points for attachment of a panel member to provide a generally horizontal supporting surface when the ladder is used in a conventional inclined position alongside of a vertical support surface with the upper end portion of the ladder being closer to the vertical support surface than the lower end in a conventional and well known manner, thereby providing more comfort and safety to users of the ladder.

Another object of the invention is to provide a ladder attachment in accordance with the preceding object together with a laterally extending, telescopically adjustable stabilizer structure having inner ends interconnected by a pivotally connected, cushioned wall engaged member. Optionally an inner platform is attached to the stabilizing structure inwardly of the horizontal supporting surface or step to provide an additional supporting surface and eliminate adjustment of the stabilizer or the wall engaging member may be omitted from the stabilizer.

An additional object of the invention is to provide a ladder attachment in accordance with the preceding objects in which the supporting surface is also capable of supporting paint containers, trays, brushes, rollers, tools, and the like normally employed by persons using a ladder.

Still another object of the invention is to provide a ladder attachment which includes a pair of spaced parallel, downwardly opening, generally inverted U-shaped channel members receiving a pair of adjacent rungs with the lowermost channel member including a member extending under the rung to secure the attachment to the ladder.

A further object of the invention is to provide a ladder attachment in accordance with the preceding object in which the ladder rung receiving channels are interconnected by a pair of angulated support members having a laterally offset upper end with brace members securing the support members together and also rigidifying the channel members combined with a horizontal panel or member rigidly attached to the uppermost channel and the upper outer end of the support members thereby providing a wide area of support for the panel with the panel itself extending laterally both inwardly and outwardly of the ladder rung and stiles thereby enabling a person to stand on the support panel under generally safe and comfortable conditions.

Still another object of the invention is to provide a ladder attachment in accordance with the preceding objects which is substantially simple in construction, dependable, easy to attach and detach, safe and comfortable in operation and relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a perspective view of a ladder step and stabilizer illustrating a second embodiment of this invention in which telescopically adjustable extension tubes are used.

FIG. 6 is a side elevational view of the attachment of FIG. 5 illustrating the addition of an inner extension platform defining a third embodiment of the invention.

FIG. 7 is a vertical sectional view taken substantially upon a plane passing along the center of FIG. 6 illustrating the structural details of this embodiment of the invention.

FIG. 8 is a fragmental plan view illustrating the inner end of the stabilizer with wall engaging member removed and forming a fourth embodiment of the invention.

FIG. 9 is a detailed sectional view taken substantially upon a plane passing along section line 9—9 on FIG. 5 illustrating further structural details of the bearing connection between the stabilizer and wall engaging member.

Figure 1:
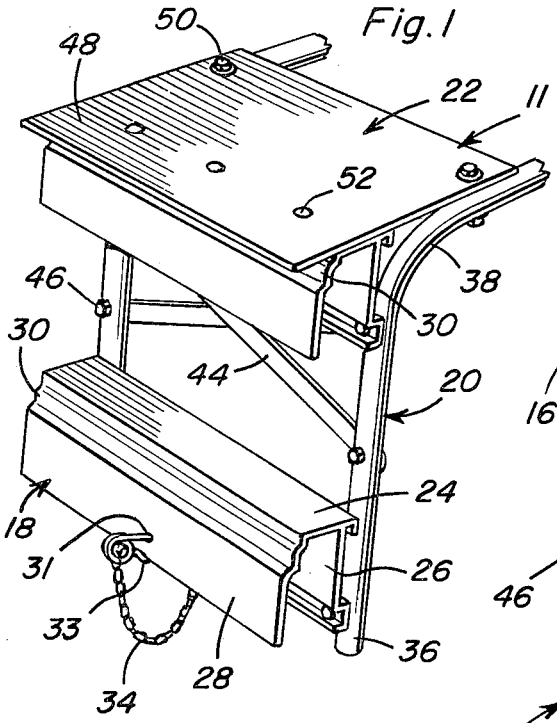
FIG. 1 is a perspective view of the basic embodiment of the attachment of the present invention.

FIG. 10 is a transverse, sectional view taken substantially upon a plane passing along section line 10—10 of FIG. 5 illustrating the structural details of the connection between the tubular inserts and the stabilizer structure to enable variation in the length of the stabilizer.

DESCRIPTION OF THE PREFERRED EMBODIMENTS

Referring now specifically to FIGS. 1–4 of the drawings, the basic structure of ladder attachment of the present invention is generally designated by the numeral 11 and is illustrated in associated with a conventional ladder structure generally designated by reference numeral 12 and including a pair of stiles 14 interconnected by a plurality of horizontally disposed, parallel rungs 16 which may be of circular or cylindrical configuration as illustrated, or of D-shaped configuration as conventionally employed in many metal ladders.

The ladder attachment 11 includes a pair of ladder rung receiving members which are generally vertically spaced and parallel to each other and designated generally by numeral 18 combined with a pair of support members each generally designated by the numeral 20 and a supporting surface generally designated by numeral 22. Each rung receiving member 18 is of generally inverted U-shaped or channel-shaped configuration and includes a bight portion 24, a downwardly extending inner wall 26 and a downwardly extending outer wall 28 with the wall 28 including a plurality of offset portions 30 which enables the walls to receive ladder rungs 16 having different transverse dimensions. The lowermost edges of the walls 26 and 28 of the lower rung receiving member 18 receive a transverse rod or pin 31 that extends through aligned apertures 32 in the walls 26 and 28 located below the ladder rung 16 for securing the rung receiving members 18 to the rungs 16. The pin 31 may be tethered to the lower rung receiving member 18 by a chain 34 or other flexible member and the pin 31 is also provided with a structure for releasably securing it in position such as a clip 33 made integrally with the outer end of the pin 31 in a conventional and well known manner which is the same structure as utilized in a conventional ladder stabilizer as shown in U.S. Pat. No. 3,568,801, issued Mar. 9, 1971.

Figure 2:
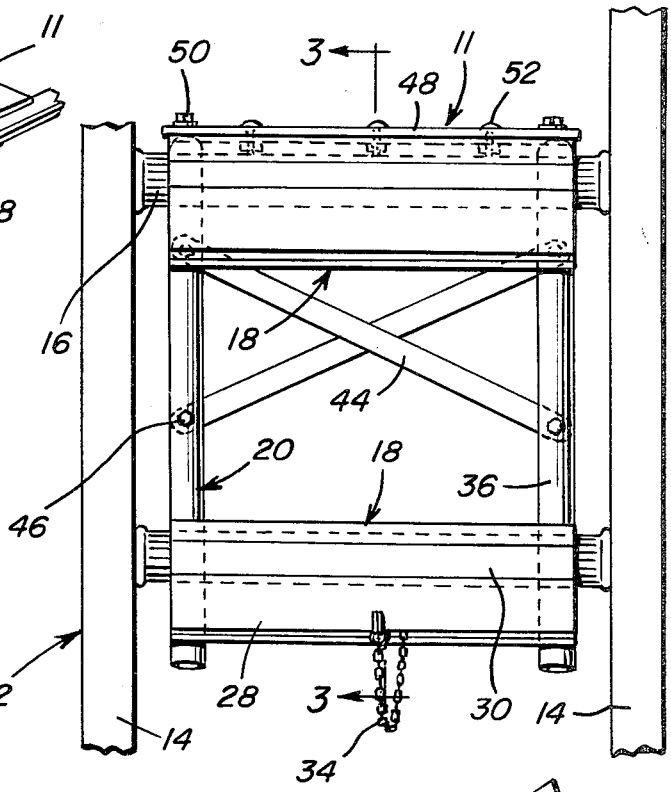
FIG. 2 is a front view of the attachment illustrating its association with a ladder as observed by a person using the ladder.

Each of the support members 20 includes a generally vertical portion 36 and a laterally extending portion 38 joined together by a curved portion 40 all of which are of tubular construction with the vertical portion 36 being secured to the lower end portions of the inner walls 26 by fastener bolts 42 or the like. The tubular support members 20 are interconnected by crossed braces 44 which have their upper ends secured to the bolts 42 which also secure the upper end portion of the vertical portions 36 to the upper rung receiving member 18 and bolts 46 secure the lower ends of the braces 44 to the vertical portions 36 generally at the center thereof as illustrated in FIG. 2, thereby enabling the upper surface of the lower rung receiving member to be used as a generally flat rung surface without interference with the toe portions of shoes being inserted between the lower end portions of the vertical portions 36 of the support members 20.

Figure 3:
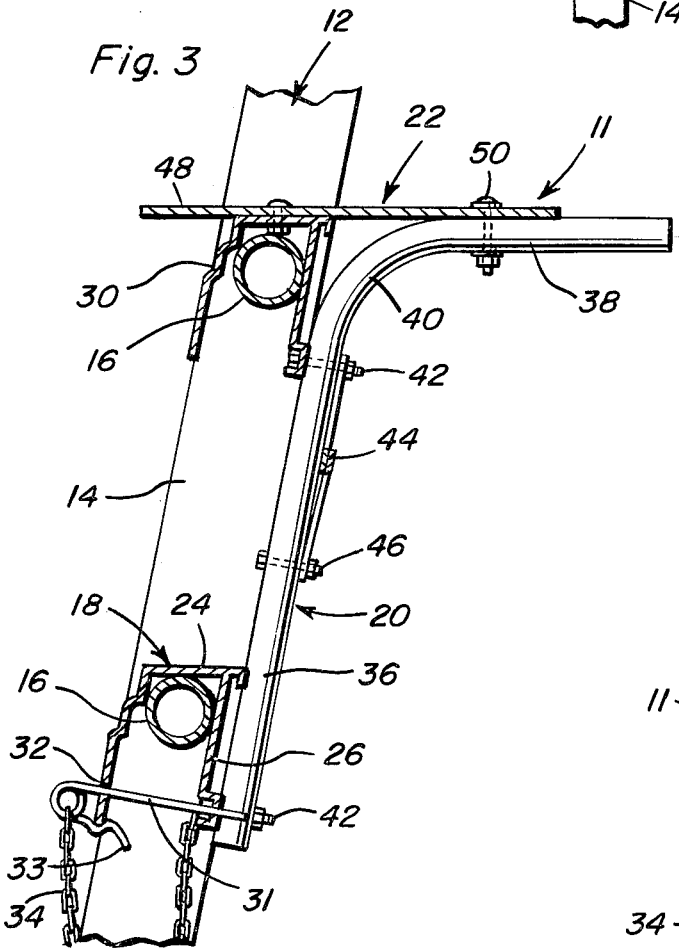
FIG. 3 is a vertical sectional view taken substantially upon a plane passing along section line 3—3 on FIG. 2 illustrating the specific structure of the ladder attachment and its association with the ladder structure.
Figure 4:
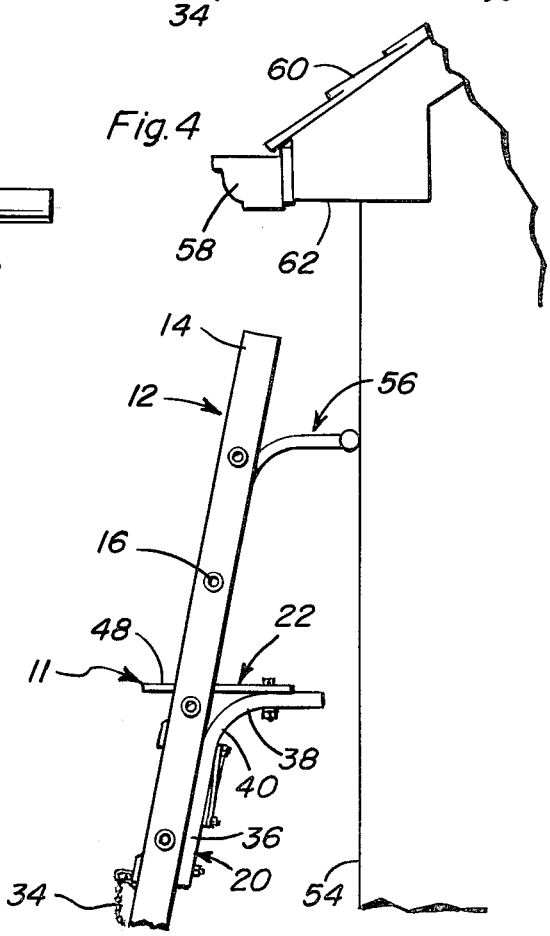
FIG. 4 is a schematic side elevational view illustrating the manner of use of the attachment when the ladder is associated with the building wall and illustrating the optional use of a conventional standoff device.

As illustrated, the upper surface of the bight portion 24 of the upper rung receiving member 18 is generally in the same horizontal plane as the upper surface of the lateral portion 38 of the support members 20 when the ladder 12 is supported in its conventional inclined position as illustrated in FIGS. 3 and 4. The supporting surface 22 overlies and is attached to the upper surfaces of the lateral portion 38 and the upper surface of the bight portion 24 of the upper rung receiving member 18 and is in the form of a rigid panel 48 having a planar upper surface forming the supporting surface 22 and is secured to the two lateral portions 38 by spaced bolts 50 and being secured to the upper surface of the upper rung receiving member 18 by a plurality of bolts or rivets 52 spaced longitudinally therealong as illustrated in FIGS. 1 and 2. As illustrated in FIG. 3, the panel 48 extends a short distance to the outer side of the ladder, that is, the side on which a person is positioned when using the ladder which is remote from a vertical building wall 54 as illustrated in FIG. 4 whereas the opposite or inner side of the ladder, that is, the portion of the ladder nearest the building wall 54 receives the support members 20 and the major portion of the panel 48. This structure provides a platform-like structure by which a person using the ladder can comfortably and safely stand on the ladder.

It is well known that standing on a ladder rung for a protracted period of time is uncomfortable and also relatively unsafe since the rounded-type of ladder rung as well as the D-type provides a relatively narrow supporting surface for the shoes of a person using the ladder. With this structure, the supporting surface provides a support in the form of a wide platform which has a sufficient width to completely receive the bottom surface of the sole and heels of the shoes of a person using the ladder thus providing substantial comfort to such a person and enabling the person to stand on the ladder for a relatively long time period of time without discomfort. Also, by providing a roughened or other friction surface on the upper surface of the panel 48, the safety factor when using the ladder can be substantially enhanced since the tendency of a person's foot to slip off the ladder can be materially reduced. As illustrated in FIG. 4, when the ladder is used with an optional stabilizer generally designated by numeral 56 such as disclosed in the patent to Werner, U.S. Pat. No. 3,568,801, the panel 48 provides an effective support for a person performing various operations along a gutter 58, adjacent roof area 60, soffit 62, or the upper portion of the wall 54. This offset or standoff 56 is optional and the panel 48 and the ladder attachment 10 operates effectively even if the upper ends of the stiles 14 lean directly against the building wall 54 or other supporting structure elevated above the lower end of the ladder in a conventional manner. The platform defined by the panel 48 also provides an effective surface for various types of tools, paint containers, paintbrushes and the like so that an effective supporting surface may be provided for items being used by the person using the ladder. For example, conventional paint trays are provided with clips along the rear edge thereof so that such clips may be used to secure a paint tray to the edge of the panel 48 with the remainder of the tray being supported on the supporting surface 22 thereby effectively supporting a paint tray in a secure manner on the attachment 11.

With this attachment, a generally horizontally disposed supporting surface is provided for the person using the ladder or for tools, paint receptacles or the like when the ladder is placed in vertically inclined operative position with the attachment including mounting means in the form of rung receiving members engaging the ladder at longitudinally spaced points. The attachment also includes laterally extending support means mounted on the mounting means and a support member or supporting surface engaging and supported by the upper portion of the mounting means and the support means with the supporting surface or member completely overlying the upper portion of the mounting means and the support means with the upper surface of the support member providing a generally unobstructed horizontal supporting surface thereby enabling a conventional ladder to be more effectively used and used more safely by a person using the ladder for various conventional purposes.

Referring now specifically to FIGS. 5–10, additional embodiments of the attachment in the form of a ladder step and stabilizer are illustrated and generally designated by reference numeral 70. The basic structure is substantially the same as illustrated in FIGS. 1–4 and corresponding primed reference numerals identify the same structure. In this embodiment, the horizontal portions or upper portions 38' may be slightly less in length but still project inwardly slightly beyond the inner edge of the panel 48' which forms a step or supporting surface. The rung receiving members 18' and the remainder of the attachment structure 20' is the same as in FIGS. 1–4.

The ladder step and stabilizer 70 constituting a second embodiment of the invention includes tubular extension 72 telescoped into the ends of the tubular upper horizontal portions 38' and are detachably and telescopically adjustably secured thereto by removable fastening means such as pins 74 which are inserted downwardly through aligned openings in the panel 48', the horizontal portion 38' and longitudinally spaced apertures in the tubular extensions 72. A suitable locking key or pin may be inserted through the bottom of the retaining pin 74 and tethered thereto in any suitable manner to provide secure and positive but yet detachable connection between the tubular extensions 72 and the horizontal portions 38' of the support structure.

Telescoped adjustably over the outer end of each of the tubular extensions 72 is a tubular member 76 which has an outwardly curved outer end portion 78 attached to an elongated wall engaging member 80. The ends of the tubular members 76 which telescope onto the tubular extensions 72 are detachably connected thereto by pins 74 identical to those which secure the tubular extension 72 to the tubular portions 38'. This structure enables the tubular extensions 72 to be telescopically adjusted and enables tubular extensions of different lengths to be interchanged so that the overall lengths of the ladder step and stabilizer 70 may be varied.

The wall engaging member 80 is a channel-shaped member 82 having a bight portion 84 disposed outwardly and provided with a cushioning material 86 thereon which may be adhesively bonded thereto or otherwise secured to the channel-shaped member. At each end of the channel-shaped member, a split pillar block bearing assembly 88 is provided which pivotally connects the out-turned tubular end portions 78 to the bight portion 84 of the channel-shaped member 82 thereby enabling the wall engaging member 80 to pivot about an axis generally parallel to the wall surface 54' as illustrated in FIG. 6 so that the force exerted on the wall 54' by the ladder and the person standing thereon will be distributed over a relatively large surface area of the wall 54' and will not mar the wall surface.

The tubular members 76 are rigidly interconnected by a brace assembly 90 which includes a pair of brace members 92 in the form of bar stock having semi-cylindrical indentations or recesses 94 formed on each end thereof to receive the tubular member 76 so that fasteners 96 may be provided to rigidly clamp the brace members 92 to the tubular members 76 adjacent to but spaced from the ends thereof which receive the tubular extensions 72. This arrangement provides a stable connection for the portions of the tubular members intermediate the panel 48' and the wall engaging member 80.

In a third embodiment of the invention illustrated in FIGS. 6 and 7, an additional inner supporting platform or panel 98 is provided inwardly of the panel 48' and is secured to the tubular extensions 72 by fastening bolts 100 or the like thereby providing an additional supporting surface for various supporting purposes. To provide a secure support for the optional platform 98, spacers 99 are provided on the fastening bolts 100 between the platform 98 and the tubular extensions 72. When the optional platform 98 is attached to the tubular extensions 72, the stabilizer is no longer adjustable in overall length.

In a fourth embodiment, shown in FIG. 8, the wall engaging member 80 is removed from the outwardly curved end portions 78 and these end portions then can directly engage the building wall.

Also, while tubes of cylindrical cross section have been illustrated, other types of structural members may be used such as box tubes or the like with the thickness of the tubes being varied depending upon the strength requirements. Also, if the tubular extensions 72 are quite long, a diagonal brace may be provided between the outer end portion of the stabilizer and the lowest rung engaging member 18'. For example, the tubular extension 72 may be 18 to 14 inches in length with multiple holes at 6-inch increments or the like in order to vary the dimensional characteristics of the stabilizer. The cushioning material on the wall engaging member 80 may be in the form of a foam material or any other material resilient material having wear characteristics capable of withstanding protracted use against various types of wall surfaces including surfaces having abrasive characteristics.

With this construction, the ladder may be effectively supported in stable position in spaced relation to the wall 54' which greatly facilitates access to the gutter 58' and adjacent roof surfaces 60' and the like. In addition, by using two ladders, a supporting member or scaffold member may be supported from the stabilizers thus facilitating various work procedures that may be performed in a safe and more comfortable manner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An attachment for a ladder having parallel longitudinally spaced rungs rigidly interconnecting a pair of longitudinal stiles for providing a generally horizontally disposed supporting surface when the ladder is placed in vertically inclined operative position, said attachment comprising mounting means engaging the ladder rungs at longitudinally spaced points and having an upper portion, laterally extending support means mounted on said mounting means a support member attached and supported by the upper portion of said mounting means and the support means with the support member completely overlying the upper portion of the mounting means and the support means with the upper surface of the support member providing an unobstructed generally horizontal supporting surface, extension means connected with a free end of the support means and forming generally a straight continuation thereof and terminating in a wall engaging means, and means swivelly connecting the wall engaging means with said extension means.

2. The structure as defined in claim 1 wherein said support member has a substantially planar surface and extends substantially throughout the distance between the stiles and extends laterally of both sides of the ladder rung and stiles with the support member extending for a greater distance from the rung toward the structure which supports the upper end of the vertically inclined ladder.

3. The structure as defined in claim 1 wherein said support means includes a pair of angulated members each having one leg attached to the mounting means and the other leg extending laterally from the upper end of the mounting means in underlying relation to the support member.

4. The structure as defined in claim 3 wherein said mounting means includes a pair of downwardly opening members for receiving adjacent ladder rungs, means on one of said downwardly opening members to releasably secure the mounting means to the ladder rungs thereby enabling the attachment to be easily removed from one pair of rungs and relocated on another pair of rungs.

5. The structure as defined in claim 4 wherein each of said downwardly opening members is of inverted channel-shaped configuration and extending substantially throughout the length of the rungs.

6. The structure as defined in claim 5 wherein the upper surface of the upper inverted channel-shaped member and the upper surfaces of said other legs of the angulated members being disposed in generally a horizontal plane and engaging the support member over a large area thereof, said support member being generally rectangular in configuration with a length and width adequate to receive and support the shoes of a person standing on the support member, a paint tray or container, tools, work materials or the like.

7. An attachment for a ladder having parallel longitudinally spaced rungs rigidly interconnecting a pair of longitudinal stiles for providing a generally horizontally disposed supporting surface when the ladder is placed in vertically inclined operative position, said attachment comprising mounting means engaging the ladder at longitudinally spaced points, laterally extending support means mounted on said mounting means, and a support member engaging and supported by the upper portion of said mounting means and support means with the support member completely overlying the upper portion of the mounting means and support means with the upper surface of the support member providing an unobstructed generally horizontal supporting surface, said support means including a pair of angulated members each having one leg attached to the mounting means and the other leg extending laterally from the upper end of the mounting means in underlying relation to the support member, and a pair of extensions connected with the other leg of each of said angulated members and forming a straight continuation thereof, a bracket member connected with and extending from each of the extensions, a wall engaging member connected to said bracket members for engaging a wall surface and supporting and stabilizing the ladder, said bracket members being of angulated configuration with outwardly extending end portions remote from the angulated members, and means swivelly connecting the wall engaging member with the bracket members.

8. The structure as defined in claim 7 wherein said extensions are adjustably and detachably connected to the other legs of the angulated members and the bracket members to enable adjustment of the overall length of the attachment and interchange of extensions of various lengths.

9. The structure as defined in claim 7 wherein said wall engaging member is an enlongated channel-shaped member, said means connecting the wall engaging member to the bracket members including pillar block bearings connected to the wall engaging member and pivotally receiving the outwardly extending end portions of the bracket members, and cushioning material on the wall engaging member to distribute the forces exerted by the wall engaging member over a large surface area and eliminating marring of a wall surface.

10. The structure as defined in claim 9 together with an optional platform attached to the extensions in alignment with and flush with the support member to provide an additional generally horizontal supporting surface and prevent longitudinal adjustment of the extensions.

11. The structure as defined in claim 7 together with brace means interconnecting said bracket members outwardly of the extensions to maintain the extensions and the bracket members in stable orientation, and crossed brace means interconnecting the legs of the angulated members attached to the mounting means.

12. The structure as defined in claim 7 wherein the extensions are tubularly configured.

13. The structure as defined in claim 7 wherein a releasably securing means is tethered to the mounting means.

14. The structure as defined in claim 7 wherein the mounting means includes a plurality of offset portions which enable the mounting means to engage securely said spaced rungs of various dimensions.

15. The structure as defined in claim 7 together with brace means interconnecting said bracket members outwardly of the extensions to maintain the extensions and the bracket members in stable orientation.

16. In combination, a ladder having spaced parallel rungs, a generally horizontally disposed support member overlying one of said rungs, means rigidly and releasably securing said support member to the ladder, said securing means including a pair of spaced, downwardly opening rung receivers to receive longitudinally spaced ladder rungs, a pair of angulated members having one leg secured to said rung receivers and the other leg projecting laterally from the upper rung receiver in generally coplanar relationship, said support member overlying and being secured to the coplanar surfaces of the upper rung receiver and said other legs of the angulated members, and a pair of extensions connected with the other leg of each of said angulated members and forming a straight continuation thereof, a bracket member connected with and extending from each of the extensions, a wall engaging member connected to said bracket members for engaging a wall surface for supporting and stabilizing the ladder, and means swivelly connecting the wall engaging member with the bracket members.

17. The combination as defined in claim 16 wherein said bracket members are of angulated configuration with outwardly extending end portions remote from the angulated members.

18. In combination, a ladder having spaced parallel rungs including an upper and lower rung, a generally horizontally disposed support member overlying one of said rungs, a pair of spaced, downwardly opening lower and upper rung receivers to receive longitudinally at least said lower and said upper rungs, a pair of angulated members each comprising a one-piece rigid member having an end terminating in one leg and another end terminating in another leg and having the one leg secured to said lower rung receiver and the other leg projecting laterally from and secured to the upper rung receiver in generally coplanar relationship, said support member overlying and extending transversely beyond stiles of the ladder and being secured to the coplanar surfaces of the upper rung receiver and being further secured to said other legs of the angulated members, the support member thereby providing rigidly and releasably securing means to the ladder and to secure additional support surface capable for support of paint containers, trays, brushes, rollers, tools and the like and including support of persons using the ladder.

* * * * *